US008480139B2

(12) United States Patent
Starr et al.

(10) Patent No.: US 8,480,139 B2
(45) **Date of Patent: *Jul. 9, 2013**

(54) DRUM BAND ASSEMBLY

(75) Inventors: Robert J. Starr, Tyrone, PA (US); R. Douglas Evans, Jr., Everett, PA (US); George Shepherd, Shiloh, OH (US)

(73) Assignee: New Pig Corporation, Tipton, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/439,224

(22) Filed: Apr. 4, 2012

(65) Prior Publication Data

US 2012/0267373 A1 Oct. 25, 2012

Related U.S. Application Data

(63) Continuation-in-part of application No. 12/967,194, filed on Dec. 14, 2010.

(60) Provisional application No. 61/286,867, filed on Dec. 16, 2009, provisional application No. 61/471,831, filed on Apr. 5, 2011.

(51) Int. Cl.
*B65D 45/00* (2006.01)
*B65D 45/30* (2006.01)

(52) U.S. Cl.
USPC ..... 292/256; 292/256.6; 292/256.65

(58) Field of Classification Search
USPC ..... 292/256, 256.5, 256.6, 256.65, 256.67, 292/256.71, 256.73; 285/420; 24/270, 271, 24/273
See application file for complete search history.

(56) References Cited

U.S. PATENT DOCUMENTS

| | | | |
|---|---|---|---|
| 506,928 | A | 10/1893 | Newman |
| 1,059,221 | A | 4/1913 | Saylor |
| 1,148,472 | A | 7/1915 | Adams |
| 1,548,692 | A | 8/1925 | Wannenwetsch |
| 1,629,747 | A | 5/1927 | Stathes et al. |
| 1,871,834 | A | 8/1932 | Astrom |
| 1,924,578 | A | 8/1933 | Vick |
| 1,948,263 | A | 2/1934 | Green |
| 1,974,201 | A | 9/1934 | Baker et al. |
| 2,065,293 | A | 12/1936 | Scudder |
| 2,091,294 | A | 8/1937 | Williams et al. |
| 2,108,407 | A | 2/1938 | Lockhart |
| 2,111,830 | A | 3/1938 | Woehler |
| 2,121,881 | A | 6/1938 | Newton |

(Continued)

OTHER PUBLICATIONS

"PIG Open-Head Drum Funnel #DRM549", http://www.newpig.com/webapp/wcs/stores/servlet/Product8_10651_10151_126387_-1_1 . . . (downloaded May 17, 2010).

(Continued)

*Primary Examiner* — Carlos Lugo
(74) *Attorney, Agent, or Firm* — Jonathan C. Parks, Esq.; Pietragallo Gordon Alfano Bosick & Raspanti, LLP

(57) ABSTRACT

A drum band assembly for securing a lid to a drum. The drum band assembly includes a band having a first free end and a second free end and an attachment device connected to the band, wherein the attachment device is adapted for removably attaching the band to the drum. The drum band assembly further includes a lid mounting device attached to the lid and the band, wherein the lid mounting device is adapted to allow the lid to open and close on the drum.

11 Claims, 13 Drawing Sheets

U.S. PATENT DOCUMENTS

| | | | | | |
|---|---|---|---|---|---|
| 2,382,083 | A | | 8/1945 | Marohl | |
| 2,395,745 | A | * | 2/1946 | King | 285/367 |
| 2,453,492 | A | | 11/1948 | Carter | |
| 2,675,253 | A | * | 4/1954 | Stade | 285/408 |
| 2,773,709 | A | * | 12/1956 | Smith | 285/187 |
| 2,868,565 | A | * | 1/1959 | Suderow | 285/308 |
| 3,045,857 | A | | 7/1962 | Lineweber | |
| 3,103,293 | A | | 9/1963 | Beutler | |
| 3,600,770 | A | * | 8/1971 | Halling | 24/279 |
| 3,637,257 | A | | 1/1972 | Uncapher | |
| 3,735,863 | A | * | 5/1973 | Osojnak | 206/400 |
| 3,817,564 | A | * | 6/1974 | Baldwin et al. | 292/256.67 |
| 3,897,884 | A | | 8/1975 | Lankenau | |
| 3,934,518 | A | | 1/1976 | Adler | |
| 4,227,618 | A | * | 10/1980 | Zipper | 215/253 |
| 4,228,909 | A | * | 10/1980 | Lecinski, Jr. | 215/253 |
| 4,341,406 | A | * | 7/1982 | Abbes et al. | 285/408 |
| 4,411,371 | A | | 10/1983 | Collier et al. | |
| 4,413,850 | A | | 11/1983 | Siblik | |
| 4,471,979 | A | * | 9/1984 | Gibb et al. | 285/373 |
| 4,570,816 | A | | 2/1986 | Ferris et al. | |
| 4,655,365 | A | | 4/1987 | Miller | |
| 4,655,481 | A | * | 4/1987 | Prueter | 285/24 |
| 4,948,185 | A | | 8/1990 | Miller | |
| 4,982,864 | A | | 1/1991 | Kusta | |
| 5,299,707 | A | | 4/1994 | Stolzman | |
| 5,385,258 | A | | 1/1995 | Sutherlin | |
| 5,438,935 | A | | 8/1995 | Seitz | |
| 5,499,430 | A | * | 3/1996 | Strazar | 24/279 |
| 5,522,625 | A | * | 6/1996 | Flick et al. | 285/409 |
| 5,931,330 | A | | 8/1999 | Starr | |
| 5,954,218 | A | | 9/1999 | Starr | |
| 6,007,120 | A | | 12/1999 | Vogt et al. | |
| 6,050,441 | A | | 4/2000 | Kuo | |
| 6,079,753 | A | * | 6/2000 | Erwin | 285/415 |
| 6,098,256 | A | * | 8/2000 | Poussard | 24/704.1 |
| 6,126,213 | A | * | 10/2000 | Jones et al. | 292/256.6 |
| 6,253,947 | B1 | | 7/2001 | Yang | |
| 6,305,054 | B1 | * | 10/2001 | Imes et al. | 24/276 |
| 7,497,489 | B2 | | 3/2009 | Baughman et al. | |
| 7,650,768 | B2 | * | 1/2010 | Fawcett et al. | 70/58 |
| 7,802,827 | B2 | * | 9/2010 | Easterday et al. | 292/256 |
| 2007/0102941 | A1 | | 5/2007 | Easterday et al. | |
| 2008/0105682 | A1 | | 5/2008 | Goddard | |
| 2009/0152271 | A1 | | 6/2009 | Kuzelka | |
| 2011/0095027 | A1 | | 4/2011 | Starr | |
| 2011/0309081 | A1 | | 12/2011 | Starr | |

OTHER PUBLICATIONS

"PIG Vapor-Control Latching Drum Lid #DRM1033", http://newpig.com/webapp/wcs/stores/servlet/Product4_10651_10151_125597_-1 (downloaded May 17, 2010).

"Mobile Arc Hood", http://www.kleissler.com/Products/body_pharmaceutical/Products/Dispensing_Sampling/ . . . (downloaded May 17, 2010).

"Scrap Handling Barrel/Drum Exhaust Hood", U.S. Dept. of Labor, Occupational Safety & Health Administration, http://www.osha.gov/SLTC/etools/battery_manufacturing/popup/general_scrap-handling.h . . . (downloaded May 17, 2010).

* cited by examiner

DRUM BAND ASSEMBLY

CROSS REFERENCE TO RELATED APPLICATION

This application claims the benefit of U.S. Provisional Patent Application Ser. No. 61/286,867 filed Dec. 16, 2009, and U.S. Provisional Patent Application Ser. No. 61/471,831 filed Apr. 5, 2011, which are fully incorporated herein by reference. This application is a continuation-in-part of co-pending U.S. application Ser. No. 12/967,194 filed Dec. 14, 2010.

BACKGROUND OF THE INVENTION

Embodiments of the present invention relate generally to a drum band assembly.

Drums used in, for example, the waste industry to contain and store potentially hazardous wastes, such as waste oils, or to store other materials are typically 55 gallon or 30 gallon drums, but can also range, for example, from 85 gallon to 5 gallon drums. Two general types of containers are common in the hazardous waste industry. These two types are open head containers and closed head containers. Closed head containers have a nonremovable top with a relatively small opening in that top. Waste materials are able to be entered into the container through the small opening, usually through the use of some type of funnel. Open head containers are containers in which the cover is substantially the same width as the drum and may be attached and detached from the container.

Open head containers utilize a flat cover which mates to the drum. Unsealed lids can be used which sit on a drum and are thus easily removed. Such unsealed lids carry the risk that hazardous material will exit the drum. Thus, the industry utilizes covers for open head containers which may be sealably secured to the drum.

Sealably securing the cover to the drum is necessary because certain potentially hazardous wastes may be placed in sealed containers. For example, volatile organic compounds must often be placed in the containers. Thus, the waste container must have a top which can be sealed to the drum in order to prevent the volatile organic compounds from exiting the container and entering the environment. Typically, the cover is secured to the drum by means of a bolt ring. In operation, the bolt ring is placed around the cover and the drum. Then, bolts are engaged with the bolt ring so as to tighten down the bolt ring around the cover and the drum.

In addition to being sealable, the cover must be removable, because materials often must be added to the drums at incremental stages. With covers currently available for use with open head containers, it is difficult to know if a proper seal has been attained. In an effort to make the sealing of the drum easier, mechanical devices have been employed, which press the bolt ring to the drum. The more often a cover is removed and resecured to a drum, the more likely that an improper seal will exist between the cover and the drum. In any event, removing the entire cover and resecuring it with a bolt ring is relatively time consuming.

In addition, because drums come in varying sizes, e.g., 55 gallon or 30 gallon drums most bolt ring configurations are made to fit one size drum and are, therefore, not adaptable to fit different size drums. In addition, drums that have been used are regularly reconditioned for reuse. The process of reconditioning usually will change the diameter of the opening compared to the new drum. Reconditioned drum use has grown substantially and as a result a large percentage of drums used in industry are reconditioned. Reconditioned drums of the same capacity can therefore have widely varying diameters.

Therefore, it would be advantageous to provide a cover that may be sealed to the waste container and remain sealed throughout the period in which materials are added to the drum. It would be further advantageous for such a drum to be capable of being opened and closed easily so as to allow materials to be added to the drum when necessary. It would also be advantageous for the assembly that secures the lid to the drum to be adaptable to fit drums of varying diameters.

SUMMARY OF THE INVENTION

An aspect of the invention includes a drum band assembly for securing a lid to a drum. The drum band assembly includes a band having a first free end and a second free end, an attachment device for removably attaching the band to the drum and a mechanism for attaching the lid to the band. The band and the mechanism for removably attaching the band to the drum are structured and arranged to provide for the drum band assembly to fit a drum having varying diameters or a drum of varying volumes, e.g., 55 gallon or 30 gallon drums.

Another aspect of the invention includes an apparatus having a drum, a drum lid and a drum band assembly for securing the drum lid to the drum. The drum band assembly includes a band having a first free end and a second free end, a mechanism for removably attaching the band to the drum and a mechanism for attaching the drum lid to the band.

In another aspect, the lid has a series of spacers that can be added to the drum band assembly so that it can be fitted to smaller diameter drums than the band assembly could without such spacers. The spacers may also be sized to fit grooves or other features of small opening drums to hold the band assembly in place.

In a further aspect, the band assembly may use a spring to provide tension such that the band assembly is held to a drum. The use of a spring may also allow the band assembly to be used with a variety of drums of different diameters.

These and other aspects of the present invention will be more fully understood following a review of this specification and drawings.

DETAILED DESCRIPTION

Figure 1:
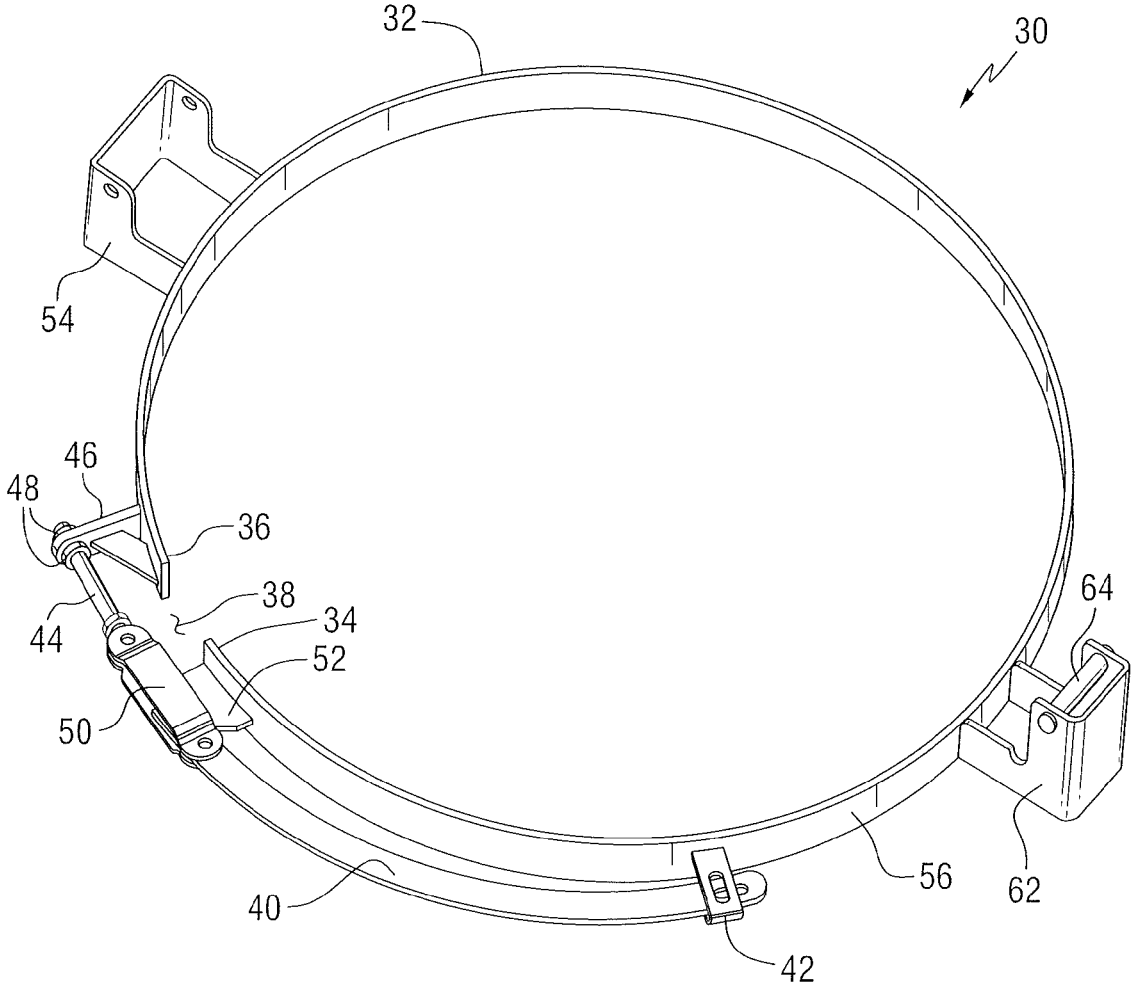
FIG. 1 illustrates an isometric view of a drum band assembly, in accordance with an aspect of the invention.

Referring to FIGS. 1-7, there is illustrated a container or drum assembly 10, in accordance with an aspect of the invention. The drum assembly 10 includes a drum 12 that may be used for storing any type of material such as, but not limited to, potentially hazardous waste materials or waste oils. The drum 12 includes a top 14 and a bottom 16. The top 14 includes an open end 18. The bottom 16 includes a closed end 20. A sidewall 22 extends generally between the top 14 and the bottom 16, e.g., the sidewall 22 extends between the open end 18 and the closed end 20. The drum 12 may be any desired size such as, for example, a 55 gallon drum or a 30 gallon drum, but can also range, for example, from 85 gallon to 5 gallon drums. The drum 12 may be made of any suitable material depending upon the particular type of waste or storage material to be contained therein.

The drum assembly 10 further includes a drum lid 24 for generally covering the open end 18 of the drum 12. In one aspect of the invention, the drum lid 24 may be sealably secured to the open end 18 of the drum 12 and may be attached and detached from the drum 12.

The drum assembly 10 further includes a drum band assembly 30 for removably securing the drum lid 24 to the drum 12. In one aspect, the drum band assembly 30 is positioned on the drum 12 adjacent to the top 14, e.g., adjacent to the open end 18 of the drum 12. As will be appreciated from the description and drawings set forth herein, the drum band assembly 30 is structured and arranged to provide for the drum band assembly 30 to fit a drum having various sizes or diameters. For example, the drum 12 may be a 55 gallon or a 30 gallon drum but other size drums may be used in association with the invention as well.

The drum band assembly 30 includes a band 32 which may be, for example, a flat metal band for circumferentially disposing the sidewall 22 of the drum 12 adjacent to the top 14 and open end 18. The band 32 of the drum band assembly 30 includes a first free end 34 at one end thereof and a second free end 36 at another end thereof. The first free end 34 and the second free end 36 define an open space 38 therebetween. The open space 38 in association with the band 32 being formed of a generally flexible material allows for the band 32 to be positioned on the described drums of varying sizes or diameters.

In accordance with an aspect of the invention, the drum band assembly 30 includes means for removably attaching the band 32 to the drum 12. This may include, for example, a lever arm 40 that is pivotally connected to the first free end 34 of the band 32. In one aspect, the lever arm 40 is connected to the first free end 34 by means of an additional extension bracket 52. This provides for the lever arm 40 to be pivotally connected to the first free end 34 of the drum 32.

Figure 2:
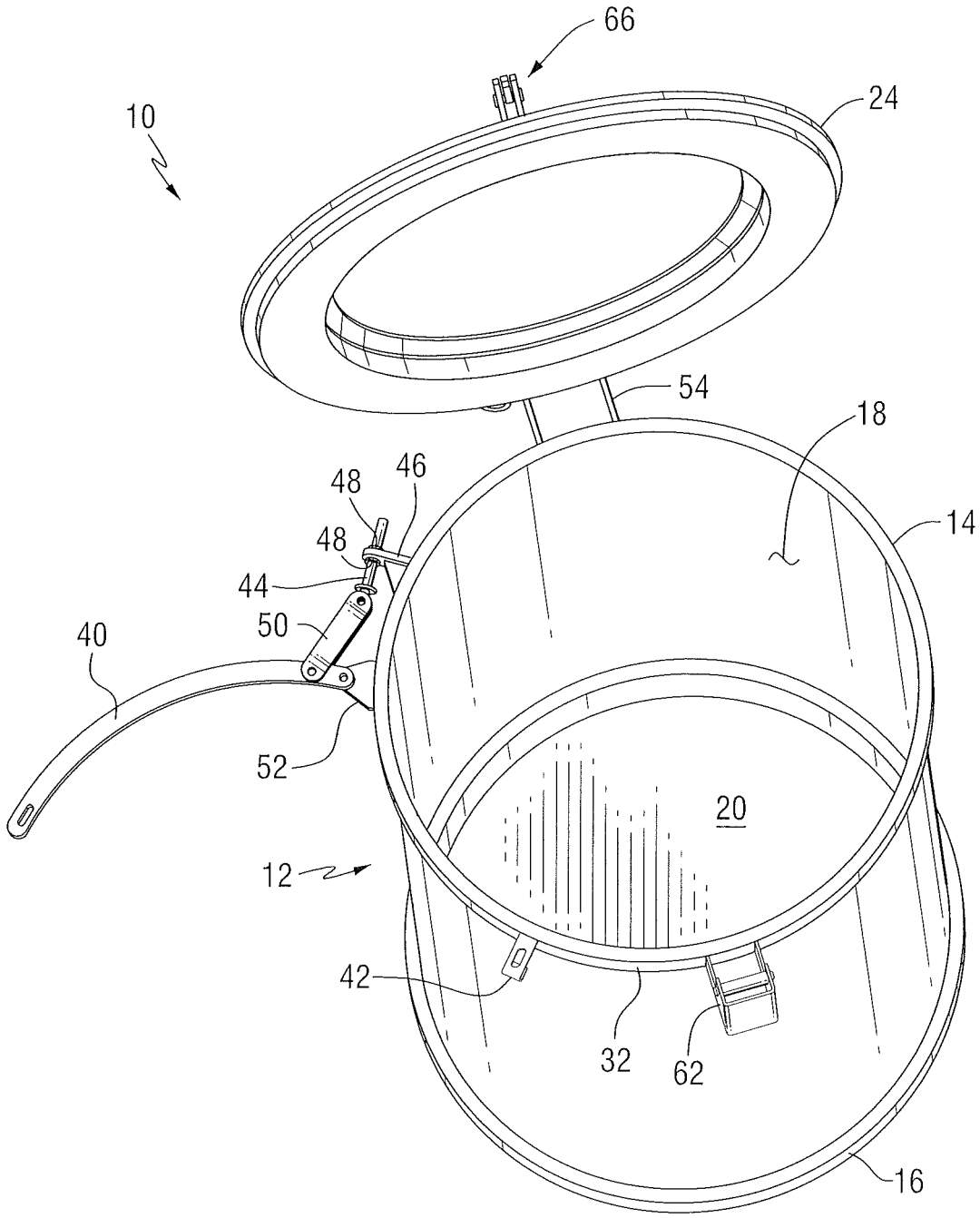
FIG. 2 illustrates a top isometric view of the drum band assembly of FIG. 1 as mounted on a drum, in accordance with an aspect of the invention.
Figure 3:
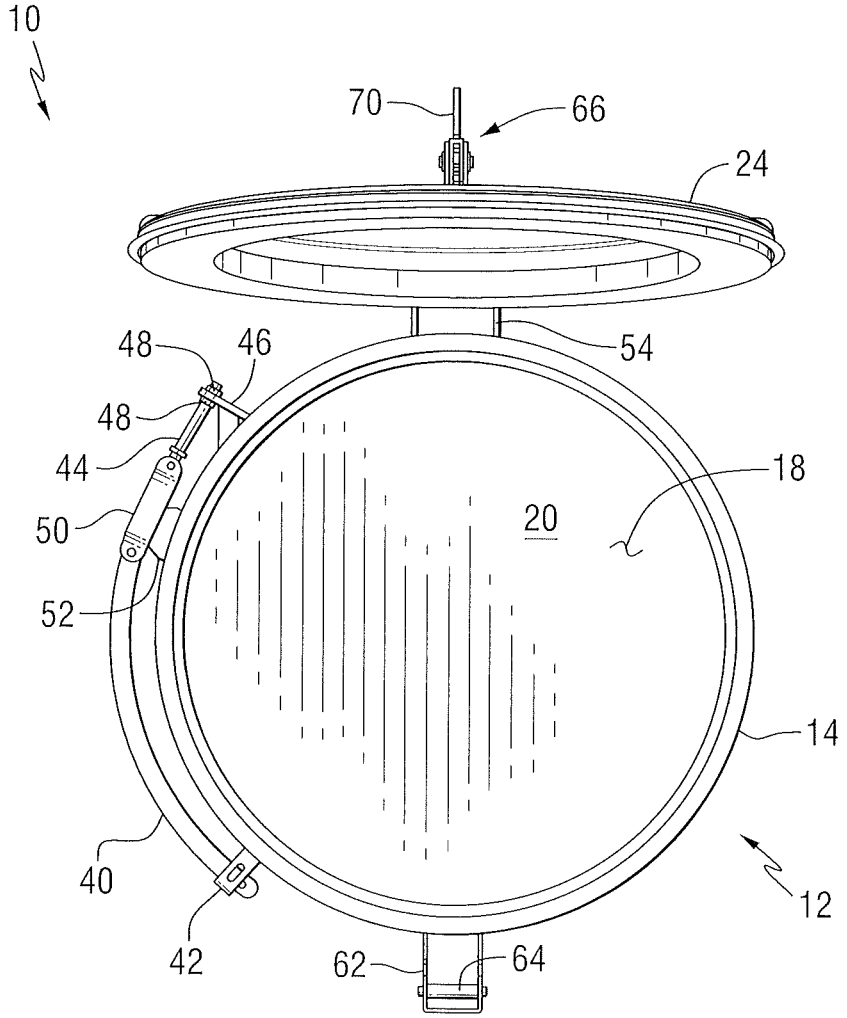
FIG. 3 illustrates a top view of the drum band assembly of FIG. 1 as mounted on a drum, in accordance with an aspect of the invention.
Figure 4:
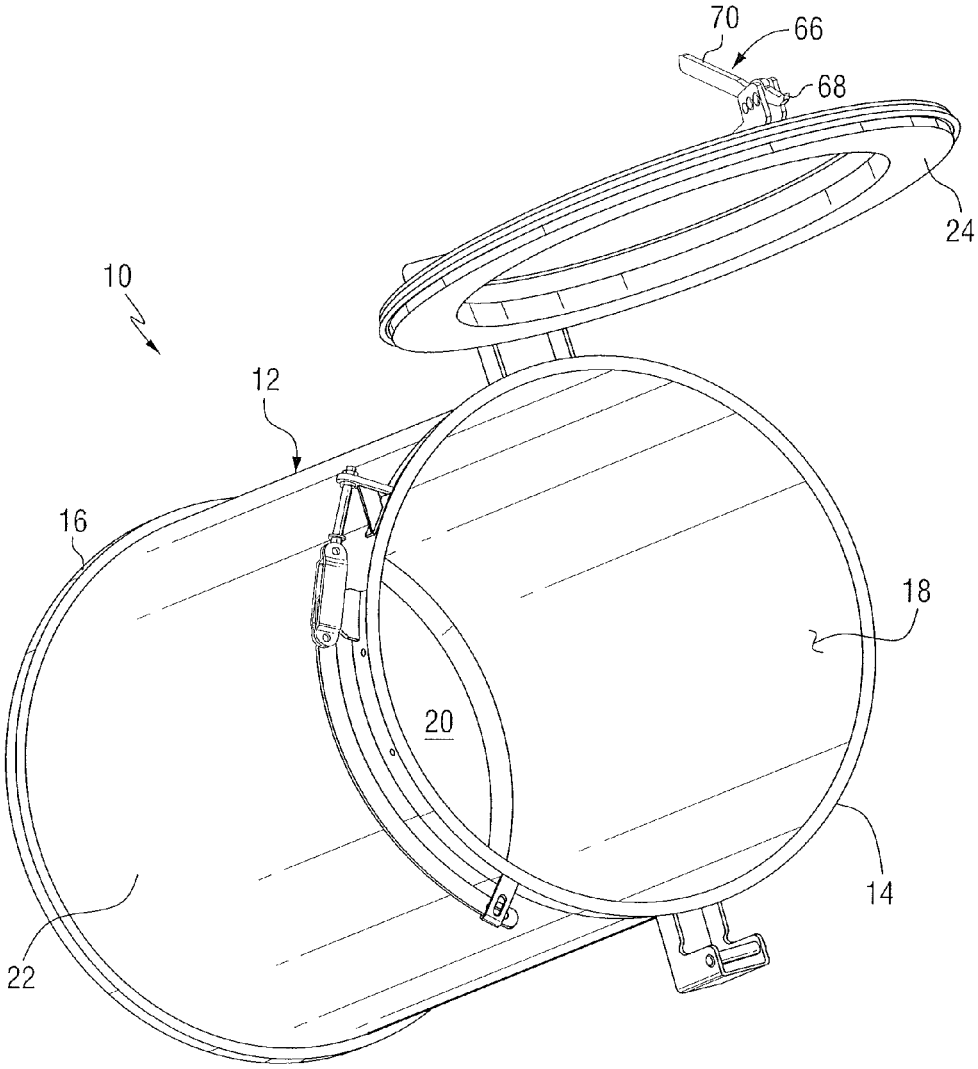
FIG. 4 illustrates an isometric view of the drum band assembly of FIG. 1 as mounted on a drum, in accordance with an aspect of the invention.

The lever arm 40 is movable between a closed position (see, for example, FIG. 1) and an open position (see, for example, FIG. 2). When in the closed position, the lever arm 40 may be secured in place by a bracket 42 that is attached to the periphery of the band 32 of the drum band assembly 30. The lever arm 40 is removably attached to the bracket 42 for opening and closing the lever arm as desired. As can be appreciated, when the drum band assembly 30 has the lever arm 40 in an open position, the drum band assembly 30 may be placed on the drum 12 or removed from the drum 12 as desired.

Once the drum band assembly 30 is positioned in the appropriate location on the drum 12, the means for removably attaching the band 32 to the drum 12 further includes a size adjusting linking mechanism. In one aspect, the size adjusting linking mechanism is connected to the second free end 36 of the band 32 and to the lever arm 40. More specifically, in one aspect the size adjusting linking mechanism includes a bolt 44 that is threadably secured to an extension 46 of the second free end 36 of the band 32. A pair of nuts 48 are provided on the bolt 44 and positioned on opposing sides of the extension 46. An opposing end of the bolt 44 is connected to a connector arm 50 which, in turn, is pivotally connected to the lever arm 40.

In operation, the drum band assembly in an open position is placed on the drum 12 and positioned adjacent to the top 14, e.g., open end 18 of the drum 12. Once in the desired position, the lever 40 is actuated to evaluate if a secure fastening can be achieved. If adjustments are needed the nuts 48 are manipulated to adjust the opening and closing diameter of the band so that once the lever arm is actuated to the closed position it will provide a secure fastening of the band 32 to the outer periphery of the drum 12.

In order to remove the drum band assembly 30 from the drum 12, the reverse operation as described above for attaching the drum band assembly is performed.

The drum band assembly 30 further includes means for attaching the lid 24 to the band 32. In one aspect, this means for attaching the drum lid 24 to the band 32 may include a lid mounting bracket 54 that is attached to a periphery of the band 32. More specifically, the lid mounting bracket 54 is attached to an outer periphery 56 of the band 32. The lid 24 includes mounting brackets 58 that may be pivotally and removably secured to the lid mounting bracket 54 by, for example, a pin 60 that is removably secured to the lid mounting bracket 54 and the mounting brackets 58 of the lid 24 (see, for example, FIG. 5). It will be appreciated that other means for removably attaching the drum lid 24 to the band 32 may be provided in accordance with aspects of the invention.

The drum band assembly 30 further includes means for latching the drum lid 24 to the band 32. In one aspect, the means for latching the drum lid 24 to the band 32 may include a latching bracket 62. In one aspect, the latching bracket 62 is mounted on the outer periphery 56 of the band 32 and positioned generally opposite to the lid mounting bracket 54. In one aspect, the latching bracket 62 includes a latching pin 64 for cooperating with a latching handle assembly 66 that may be mounted to the lid 24. The latching handle assembly is pivotally connected to the lid 24 and includes a first end 68 and a handle end 70 that is structured and arranged for cooperating with the latching pin 64 of the latching bracket between an unsecured position (see, for example, FIG. 4) and a secured or latched position (see, for example, FIG. 7). Thus, it will be appreciated that this allows for the drum lid 24 to be latched and unlatched to the drum 12 so as to provide for placement of the desired materials into the drum 12 and for removing the materials from the drum 12 as needed.

Referring to FIGS. 8-13, there is illustrated a container or drum assembly 110, in accordance with an aspect of the invention. The drum assembly 110 includes a drum 112 that may be used for storing any type of material, such as, but not limited to, potentially hazardous waste materials or waste oils. The drum 112 includes a top 114 and a bottom 116. The top 114 includes an open end 118. The bottom 116 includes a closed end. A sidewall 122 extends generally between the top 114 and the bottom 116, e.g., the sidewall 122 extends between the open end 118 and the closed end of the bottom 116. The drum 112 may be any desired size such as, for example, a 55 gallon drum or a 30 gallon drum, but can also range, for example, from 85 gallon to 5 gallon drums. The drum 112 may be made of any suitable material depending upon the particular type of waste or storage material to be contained therein.

The drum assembly 110 further includes a drum lid 124 for generally covering the open end 118 of the drum 112. In one aspect of the invention, the drum lid 124 may be sealably secured to the open end 118 of the drum 112 and may be attached and detached from the drum 112.

The drum assembly 110 further includes a drum band assembly 130 for removably securing the drum lid 124 to the drum 112. In one aspect, the drum band assembly 130 is positioned on the drum 112 adjacent to the top 114, e.g., adjacent to the open end 118 of the drum 112. As will be appreciated from the description and drawings set forth herein, the drum band assembly 130 is structured and arranged to provide for the drum band assembly 130 to fit a drum having various sizes or diameters. For example, the drum 112 may be a 55 gallon or a 30 gallon drum but other size drums may be used in association with the invention as well.

The drum band assembly 130 includes a band 132 which may be, for example, a flat metal or polymeric band for circumferentially disposing the sidewall 122 of the drum 112 adjacent to the top 114 and open end 118. The band 132 of the drum band assembly 130 includes a first free end 134 at one end thereof and a second free end 136 at another end thereof. The first free end 134 and the second free end 136 define an open space 138 therebetween. The open space 138 in association with the band 132 being formed of a generally flexible material, and the various aspects of the present invention allows for the band 132 to be positioned on the described drums of varying sizes or diameters.

In accordance with an aspect of the invention, the drum band assembly 130 includes an attachment device that attaches the band 132 to the drum 112. The attachment device may include, for example, a lever arm 140 that is pivotally connected to the first free end 134 of the band 132. In one aspect, the lever arm 140 is connected to the first free end 134 with an extension bracket 152. The extension bracket 152 provides for the lever arm 140 to be pivotally connected to the first free end 134 of the drum 132.

Figure 10:
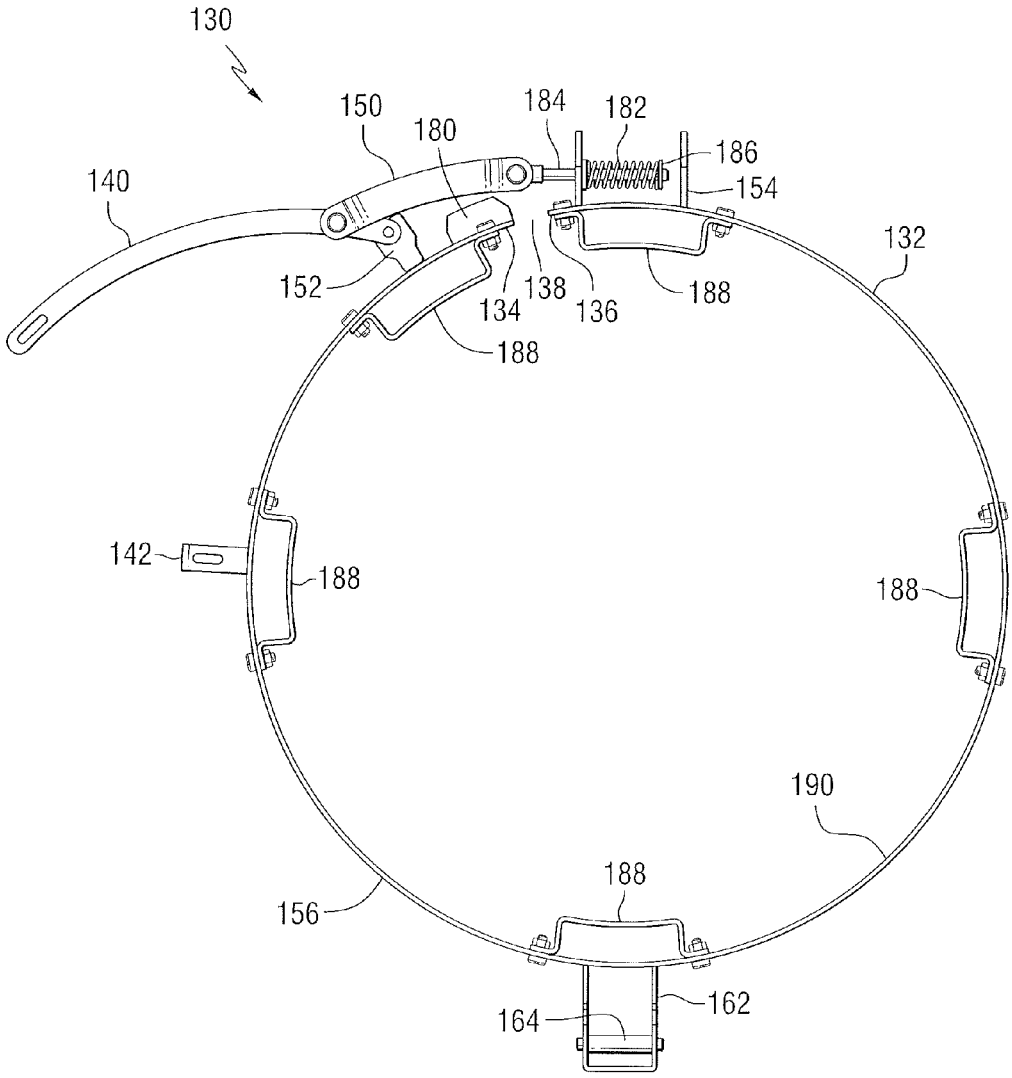
FIG. 10 illustrates a top view of the drum band assembly of FIG. 8 in accordance with an aspect of the invention.
Figure 11:
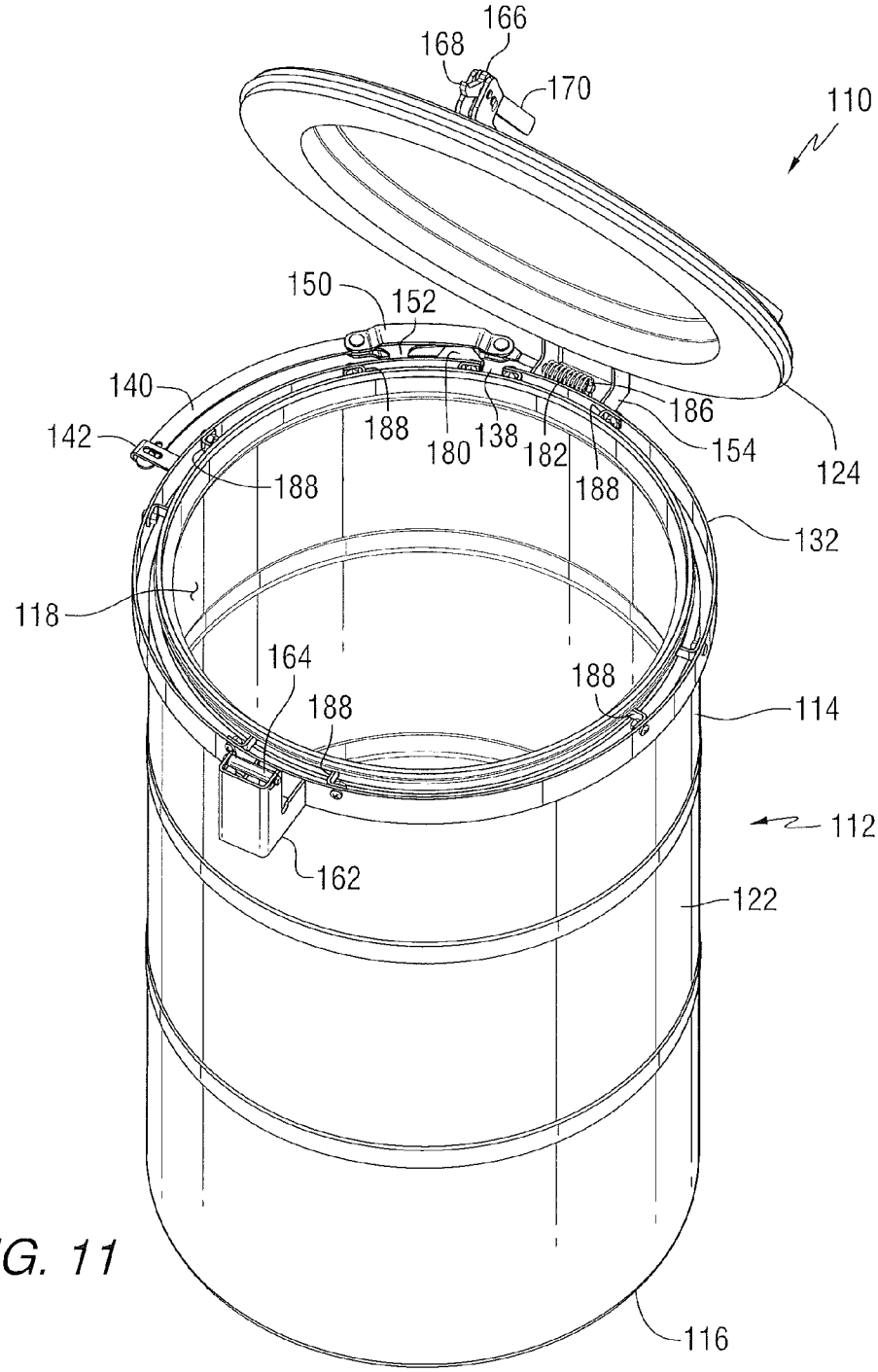
FIG. 11 illustrates an isometric view of the drum band assembly of FIG. 8 as mounted on a drum, in accordance with an aspect of the invention.
Figure 12:
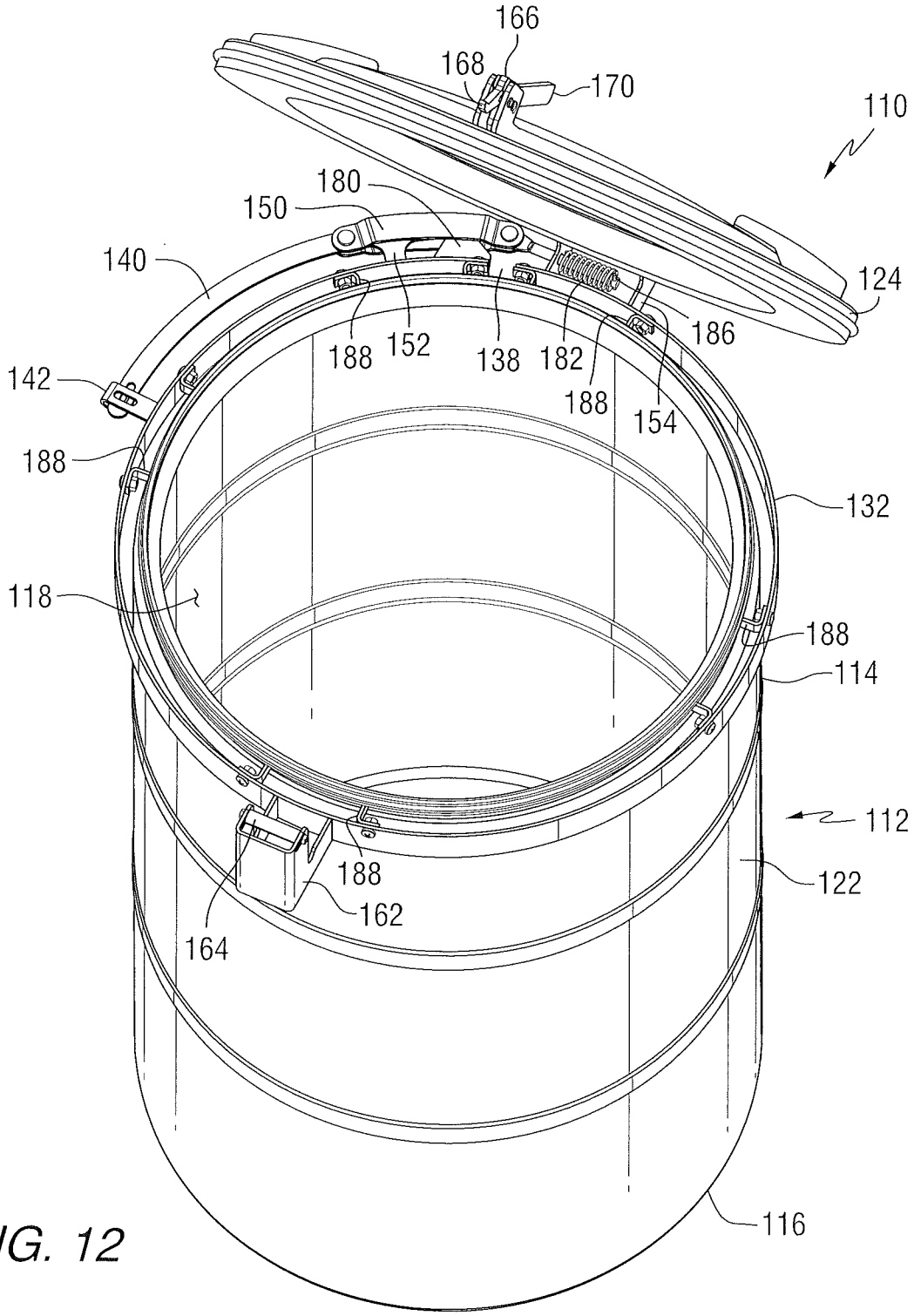
FIG. 12 illustrates an isometric view of the drum band assembly of FIG. 8 as mounted on a drum, in accordance with an aspect of the invention.
Figure 13:
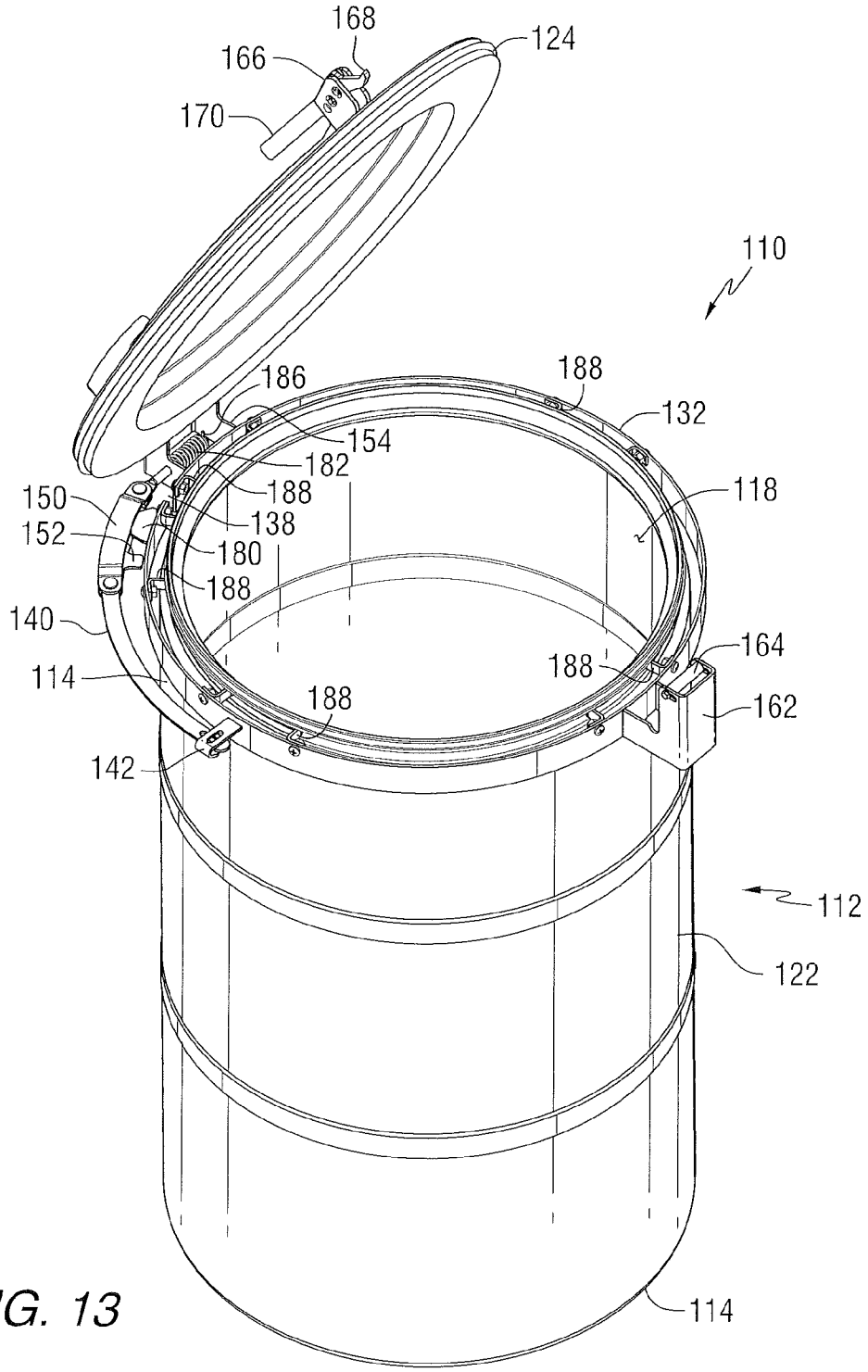
FIG. 13 illustrates an isometric view of the drum band assembly of FIG. 8 as mounted on a drum, in accordance with an aspect of the invention.

The lever arm 140 is movable between a closed position (see, for example, FIG. 9) and an open position (see, for example, FIG. 10). When in the closed position, the lever arm 140 may be secured in place by a bracket 142, and a connector arm 150 may be aligned with a guide 180 and pivotally connected to the lever aim 140. The bracket 142 and the guide 180 may be attached to an outer periphery 156 of the band 132 of the drum band assembly 130. The lever arm 140 is removably attached to the bracket 142 for opening and closing the lever arm 140 as desired. As can be appreciated, when the drum band assembly 130 has the lever aim 140 in an open position, the drum band assembly 130 may be placed on the drum 112 or removed from the drum 112 as desired.

The attachment mechanism may further include a spring 182, e.g., a compression spring, within a lid mounting bracket 154 that is attached to the periphery 156 of the band 132. The inside diameter of the spring 182 may be larger than the diameter of a pin 184 so that the pin 184 may fit inside the diameter of the spring 182. In various embodiments, the inside diameter of the spring 182 may contact the surface of the pin 184, or the spring 182 and the pin 184 may be sized such that the spring 182 and the pin 184 are not in contact. In one aspect, the pin 184 is connected to the connector arm 150. The spring 182 may be retained on the pin 184 by way of a retainer 186. The retainer 186 may be any type of appropriate retainer, such as, for example, a bolt that is adapted to be engaged on a threaded end of the pin 184, a split pin or a cotter pin, or a cap that is force fit, crimped, welded, or adhesively fixed onto an end of the pin 184. The retainer 186 may be sized larger than the outside diameter of the spring 182. Also, in various embodiments, a washer (not shown) may be interposed between the spring 182 and the retainer 186 to provide further stability in retention of the spring 182 on the pin 184.

In various embodiments, the spring 182 may be any type of coil spring, a leaf spring, an elastomeric band or bands, or any other type of device that provides tension (e.g., hoop tension) or compression and that keeps the ends 134 and 136 drawn toward each other when the lever arm 140 is in the closed position. In various embodiments, the spring 182 may include multiple springs or devices that work in conjunction to keep the ends 134 and 136 drawn toward each other when the lever arm 140 is in the closed position. In various embodiments, the spring 182 is comprised of a metal, a polymer, or any other type of suitable material.

The drum band assembly 130 may optionally include spacers 188 that are attached to an inner periphery 190 of the band 132 using, for example, any type of appropriate fasteners, such as a bolted joint or a rivet. The spacers 188 may be used to ensure a proper fit when it is desired to place the drum band assembly 130 on a smaller diameter drum 112.

Figure 5:
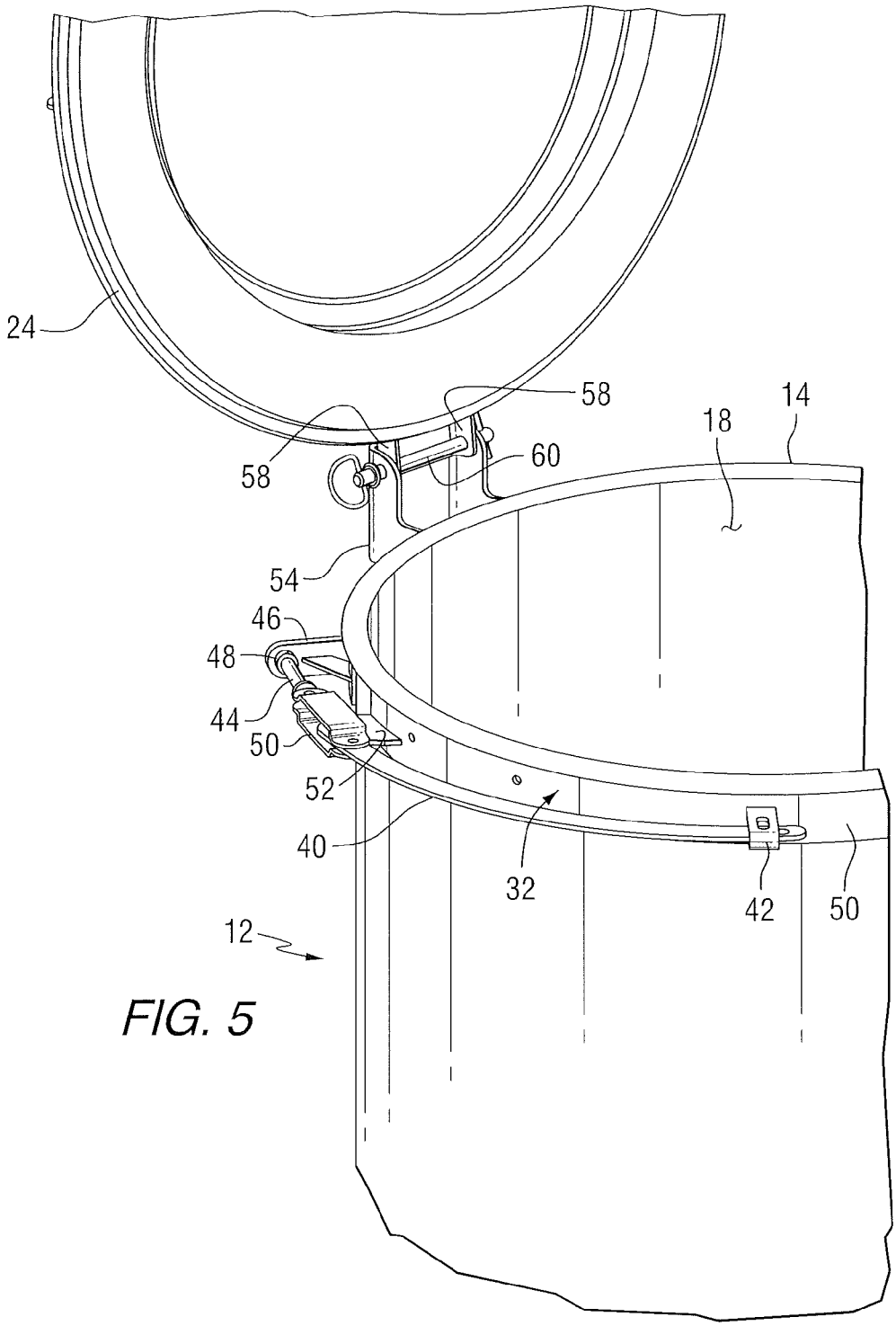
FIG. 5 is an enlarged, partial view of the drum band assembly of FIG. 1 as mounted on a drum, in accordance with an aspect of the invention.
Figure 6:
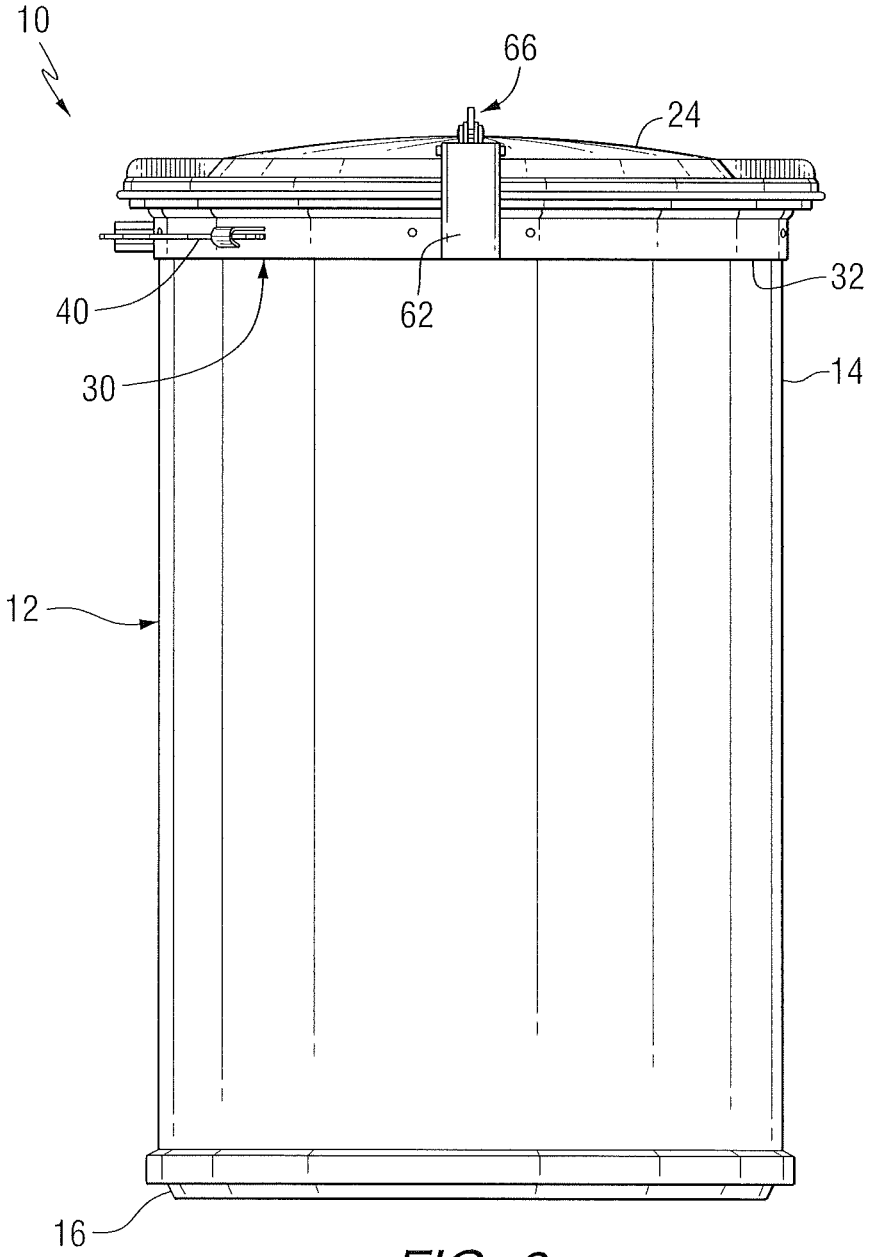
FIG. 6 is side view of the drum band assembly of FIG. 1 as mounted on a drum, in accordance with an aspect of the invention.
Figure 7:
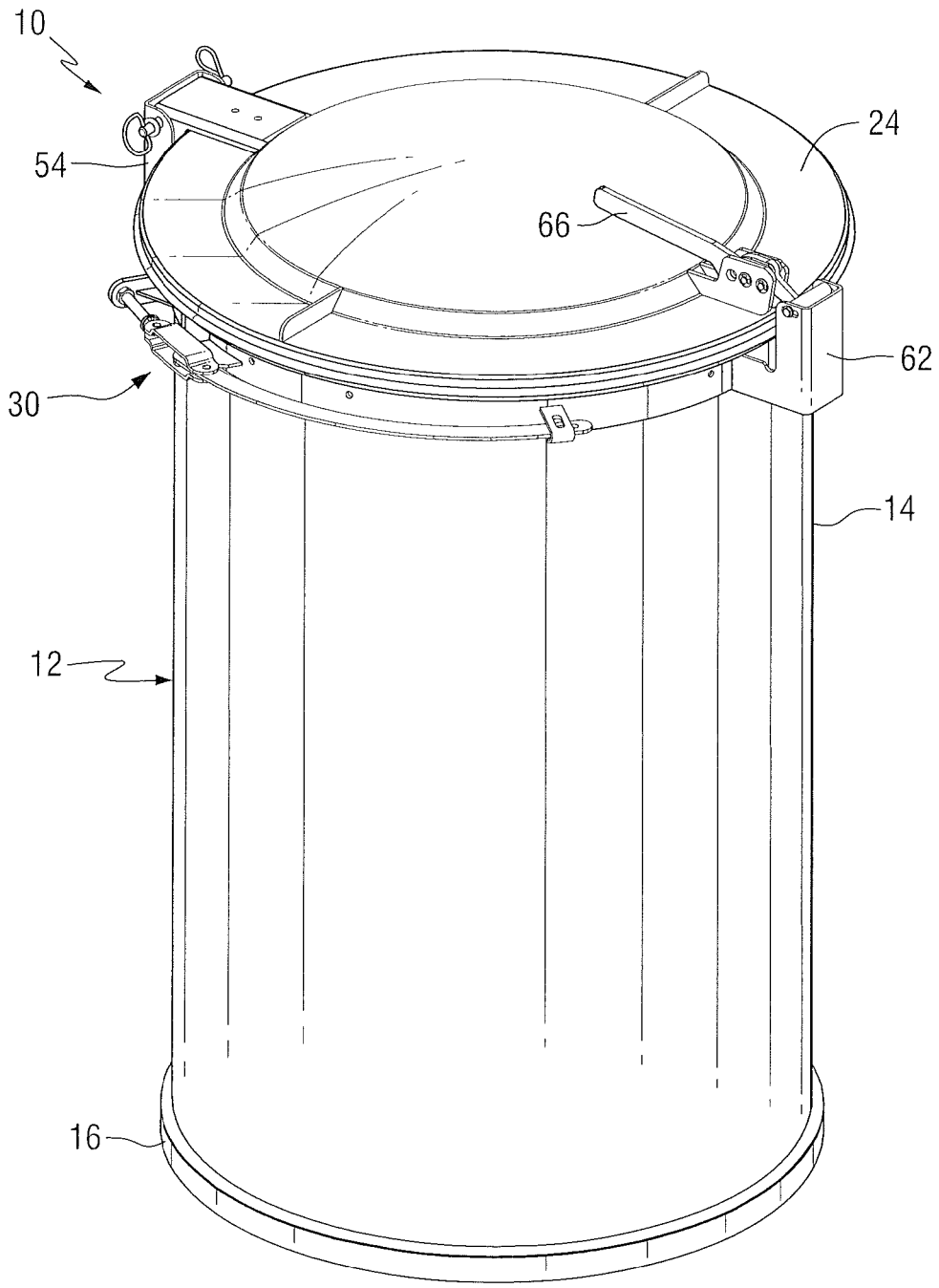
FIG. 7 is an isometric view of the drum band assembly of FIG. 1 as mounted on a drum, in accordance with an aspect of the invention.
Figure 8:
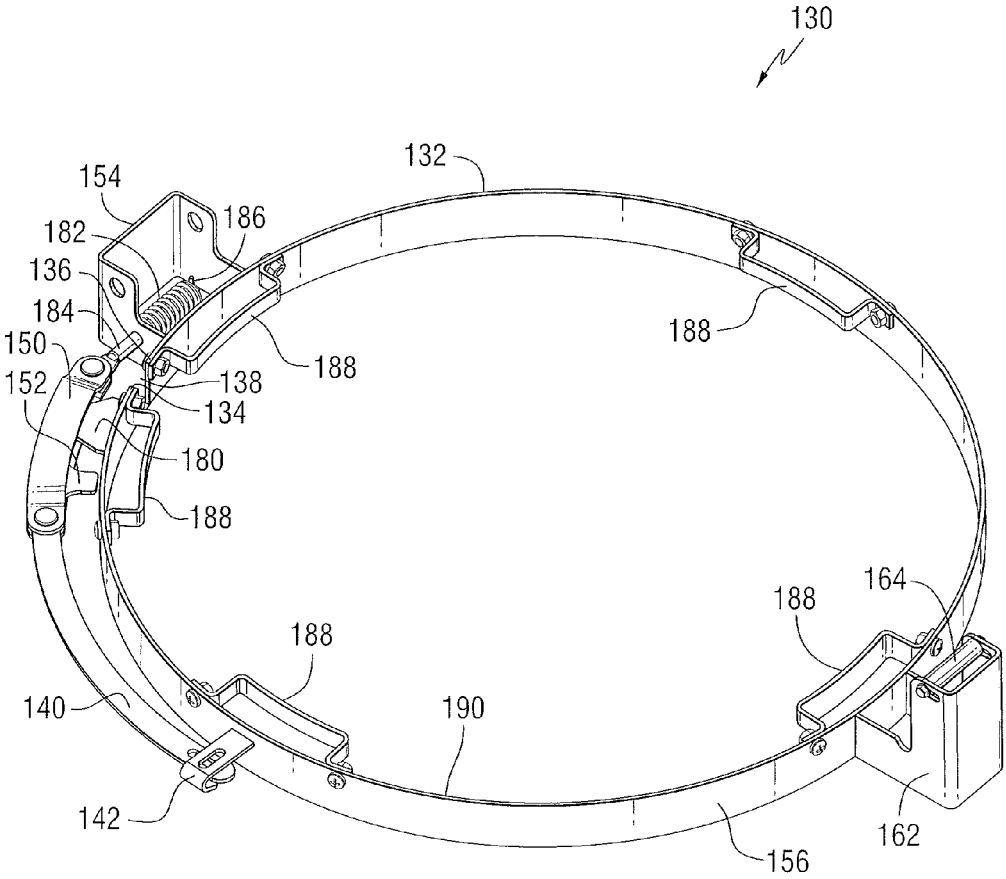
FIG. 8 illustrates an isometric view of a drum band assembly, in accordance with an aspect of the invention.
Figure 9:
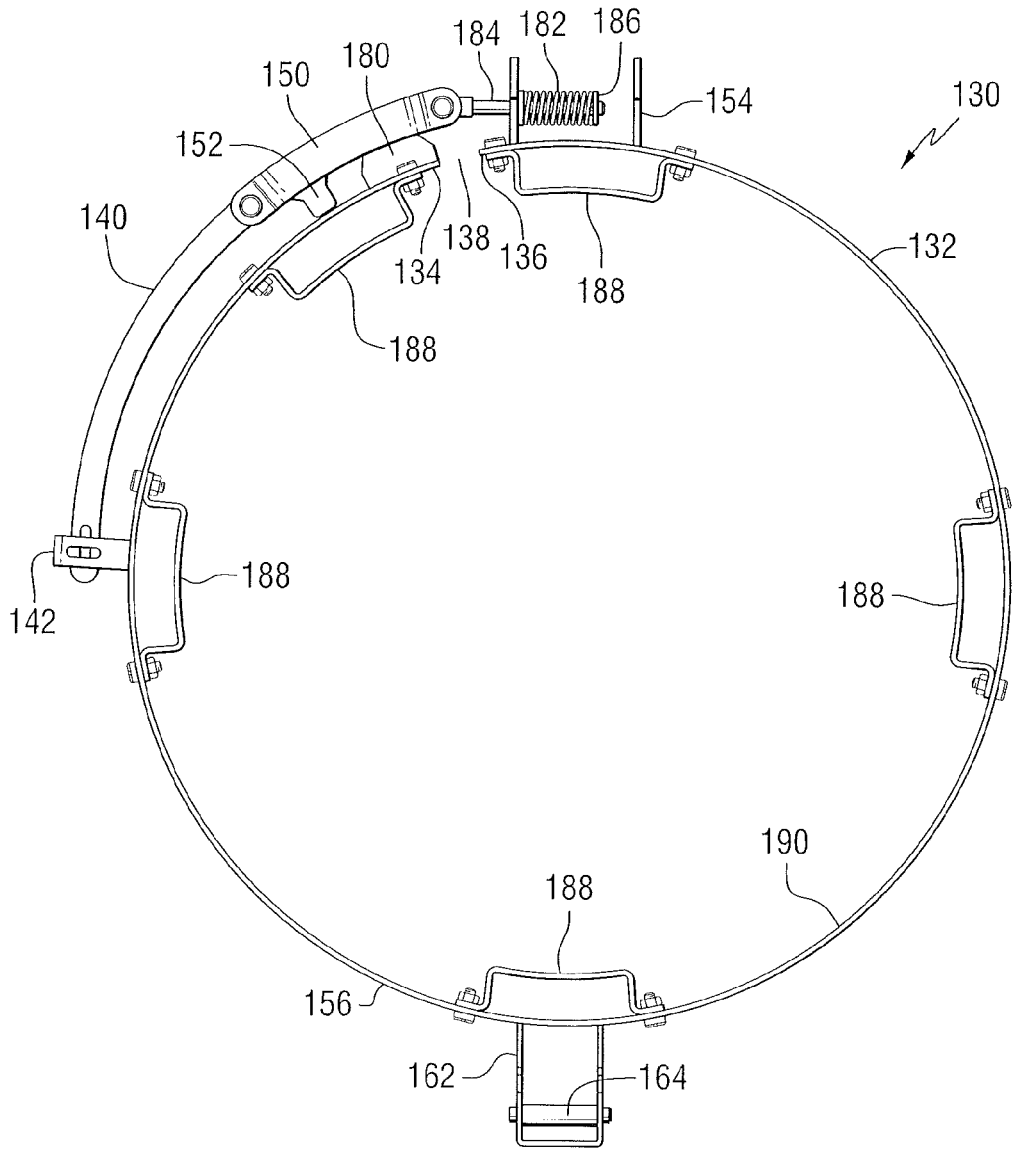
FIG. 9 illustrates a top view of the drum band assembly of FIG. 8 in accordance with an aspect of the invention.

The lid 124 includes mounting brackets that may be pivotally and removably secured to the lid mounting bracket 154 by, for example, a pin that is removably secured to the lid mounting bracket 154 and the mounting brackets of the lid 124 in the manner as illustrated and described herein in connection with FIG. 5. It will be appreciated that other methods and devices for removably attaching the drum lid 124 to the band 132 may be provided in accordance with aspects of the invention.

The drum band assembly 130 further includes a mechanism for latching the drum lid 124 to the band 132. In one aspect, the mechanism for latching the drum lid 124 to the band 132 may include a latching bracket 162. In one aspect, the latching bracket 162 is mounted on the outer periphery 156 of the band 132 and positioned generally opposite to the lid mounting bracket 154. In one aspect, the latching bracket 162 includes a latching pin 164 for cooperating with a latching handle assembly 166 that may be mounted to the lid 124. The latching handle assembly is pivotally connected to the lid 124 and includes a first end 168 and a handle end 170 that is structured and arranged for cooperating with the latching pin 164 of the latching bracket between an unsecured position (see, for example, FIG. 11) and a secured or latched position as illustrated and described herein in connection with FIG. 7. Thus, it will be appreciated that this allows for the drum lid 124 to be latched and unlatched to the drum 112 so as to provide for placement of the desired materials into the drum 112 and for removing the materials from the drum 112 as needed.

In operation, a user of the drum band assembly 130 determines whether the drum 112 is sized such that the spacers 188 need to be present on the band 132 for a correct fit. The user then either adds or removes, as desired, the spacers 188. The lever arm 140 is actuated in an open position (See FIG. 9) and is placed on the drum 112 and positioned adjacent to the top 114, e.g., open end 118, of the drum 112. Once in the desired position, the lever 140 is actuated toward the drum 112, thus, placing a compression load on the spring 182 and drawing the first free end 134 toward the second free end 136, thus, providing a snug fit of the band 132 on the drum 112.

In order to remove the drum band assembly 130 from the drum 112, the reverse operation as described above for attaching the drum band assembly is performed.

Whereas particular embodiments of this invention have been described above for purposes of illustration, it will be evident to those skilled in the art that numerous variations of the details of the present invention may be made without departing from the invention as defined in the appended claims.

What is claimed is:

1. A drum band assembly for securing a lid to a drum, the drum band assembly comprising:

a band having a first free end and a second free end;

a first lid mounting bracket connected to the second free end of the band;

an attachment device adapted for removably attaching the band to the drum, the attachment device comprising:

a lever arm pivotally connected to the first free end of the band; a connector arm having one end connected to the lever arm; a pin having a first end attached to the connector arm and a second end attached slidably engaging the first lid mounting bracket; and a spring radially disposed on the pin;

a second lid mounting bracket connected to the lid and pivotally engaging the first lid bracket, wherein the first lid mounting bracket and the second lid mounting bracket are is adapted to allow the lid to open and close on the drum;

a first latching assembly connected to the lid; and a second latching assembly connected to the band such that cooperation of the first latching assembly and the second latching assembly secures the lid in the closed position.

2. The drum band assembly of claim 1, wherein the spring applies hoop tension between the first free end of the band and the second free end of the band.

3. The drum band assembly of claim 1, wherein the spring comprises a compression spring.

4. The drum band assembly of claim 1, wherein the attachment device further includes a retainer attached to the second end of the pin, and wherein the retainer is adapted to retain the spring on the pin.

5. The drum band assembly of claim 1, further comprising at least one spacer attached to the band, wherein the spacer is adapted to permit the drum band assembly to be secured to a plurality of drum sizes.

6. An apparatus, comprising:

a drum having an open end, a closed end and a sidewall extending therebetween;

a drum lid for covering the open end of the drum; and a drum band assembly for removably securing the drum lid to the drum, the drum band assembly comprising:

a band having a first free end and a second free end;

a first lid mounting bracket connected to the second free end of the band;

an attachment device adapted for removably attaching the band to the drum, the attachment device comprising:

a lever arm pivotally connected to the first free end of the band; a connector arm having one end connected to the lever arm; a pin having a first end attached to the connector arm and a second end attached slidably engaging the first lid mounting bracket; and a spring radially disposed on the pin;

a second lid mounting bracket connected to the lid and pivotally engaging the first lid bracket, wherein the first lid mounting bracket and the second lid mounting bracket are adapted to allow the lid to open and close on the drum;

a first latching assembly connected to the lid; and a second latching assembly connected to the band such that cooperation of the first latching assembly and the second latching assembly secures the lid in the closed position.

7. The apparatus of claim 6, wherein the spring comprises a compression spring.

8. The apparatus of claim 6, wherein the attachment device further includes a retainer attached to the second end of the pin, and wherein the retainer is adapted to retain the spring on the pin.

9. The apparatus of claim 6, further comprising at least one spacer attached to the band, wherein the spacer is adapted to permit the drum band assembly to be secured to a plurality of drum sizes.

10. The apparatus of claim 6, wherein the drum band assembly is positioned adjacent the open end of the drum.

11. The apparatus of claim 6, wherein spring applies hoop tension between the first free end of the band and the second free end of the band.

* * * * *